US011505846B2

(12) United States Patent
Abukawa et al.

(10) Patent No.: US 11,505,846 B2
(45) Date of Patent: Nov. 22, 2022

(54) HOT STAMPED PART AND MANUFACTURING METHOD THEREOF

(71) Applicant: NIPPON STEEL CORPORATION, Tokyo (JP)

(72) Inventors: Genki Abukawa, Tokyo (JP); Kunio Hayashi, Tokyo (JP); Kazuo Hikida, Tokyo (JP); Kaoru Kawasaki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 142 days.

(21) Appl. No.: 16/475,321

(22) PCT Filed: Jan. 17, 2017

(86) PCT No.: PCT/JP2017/001360

§ 371 (c)(1),
(2) Date: Jul. 1, 2019

(87) PCT Pub. No.: WO2018/134874

PCT Pub. Date: Jul. 26, 2018

(65) Prior Publication Data

US 2019/0330711 A1 Oct. 31, 2019

(51) Int. Cl.

| | |
|---|---|
| ***C21D 9/48*** | (2006.01) |
| ***C21D 1/673*** | (2006.01) |
| ***C21D 6/00*** | (2006.01) |
| ***C21D 6/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.

CPC ..... *C21D 9/48* (2013.01); *C21D 1/673* (2013.01); *C21D 6/004* (2013.01); *C21D 6/005* (2013.01); *C21D 6/008* (2013.01); *C21D 6/02* (2013.01); *C22C 38/001* (2013.01); *C22C 38/002* (2013.01); *C22C 38/02* (2013.01); *C22C 38/04* (2013.01); *C22C 38/06* (2013.01); *C22C 38/44* (2013.01); *C22C 38/48* (2013.01); *C22C 38/50* (2013.01); *C22C 38/54* (2013.01); *C22C 38/58* (2013.01); *C21D 2211/001* (2013.01); *C21D 2211/008* (2013.01)

(58) Field of Classification Search

CPC ..... C21D 9/48; C21D 1/673; C21D 6/004; C21D 6/005; C21D 6/008; C21D 6/02; C21D 2211/001; C21D 2211/008; C22C 38/001; C22C 38/002; C22C 38/02; C22C 38/04; C22C 38/06; C22C 38/44; C22C 38/48; C22C 38/50; C22C 38/54; C22C 38/58

See application file for complete search history.

(56) References Cited

U.S. PATENT DOCUMENTS

| | | | | |
|---|---|---|---|---|
| 2009/0007999 | A1 | 1/2009 | Asai | |
| 2012/0118440 | A1 | 5/2012 | Nakanishi et al. | |
| 2012/0211132 | A1 | 8/2012 | Altschuler et al. | |
| 2015/0027602 | A1 | 1/2015 | Murakami et al. | |
| 2015/0354035 | A1 | 12/2015 | Mizuta et al. | |
| 2016/0145704 | A1 | 5/2016 | Kawasaki et al. | |
| 2017/0321294 | A1* | 11/2017 | Arlazarov | C22C 38/28 |
| 2018/0312947 | A1 | 11/2018 | Murakami et al. | |

FOREIGN PATENT DOCUMENTS

| | | | |
|---|---|---|---|
| CN | 102676930 | A | 9/2012 |
| JP | 2006-152427 | A | 6/2006 |
| JP | 2006-283064 | A | 10/2006 |
| JP | 2010-275612 | A | 12/2010 |

(Continued)

OTHER PUBLICATIONS

"How can you strengthen super strong steel?", The Iron and Steel Institute of Japan, 1982, vol. 68, p. 2595, total 5 pages.

"Microstructures and Mechanical Properties of V and/or Nb Bearing Ultrahigh Strength Hot Stamped Steel Components", Journal of the Iron & Steel Institute of Japan, Sep. 1, 2014, vol. 100, No. 9, pp. 1114-1122, total 11 pages.

International Search Report for PCT/JP2017/001360 dated Apr. 18, 2017.

Written Opinion of the International Searching Authority for PCT/JP2017/001360 (PCT/ISA/237) dated Apr. 18, 2017.

(Continued)

*Primary Examiner* — Nicole M. Buie-Hatcher
*Assistant Examiner* — Jiangtian Xu
(74) *Attorney, Agent, or Firm* — Birch, Stewart, Kolasch & Birch, LLP

(57) ABSTRACT

A blank material is formed from a steel sheet, a first quenching of the blank material is performed, and a second quenching of the blank material is performed after the first quenching. When the first quenching is performed, the blank material is heated to a first temperature of not lower than (Ac3 point—50)° C. nor higher than 1200° C. at an average heating rate of 2° C./sec or more, and the blank material is cooled from the first temperature to a second temperature of 250° C. or lower. When the second quenching is performed, the blank material is heated from the second temperature to a third temperature of not lower than (Ac3 point—50)° C. nor higher than 1200° C. at an average heating rate of 2° C./sec or more, and the blank material is cooled from the third temperature to a fourth temperature of 250° C. or lower. Forming of the blank material is performed in the first quenching or the second quenching or both of the above.

7 Claims, No Drawings

(56) References Cited

FOREIGN PATENT DOCUMENTS

| | | | |
|---|---|---|---|
| JP | 2012-41613 | A | 3/2012 |
| JP | 5402191 | B2 | 1/2014 |
| JP | 2014-118613 | A | 6/2014 |
| JP | 2014-156653 | A | 8/2014 |
| JP | 5756773 | B2 | 7/2015 |
| WO | WO 2015/041159 | A1 | 3/2015 |
| WO | WO 2016/079675 | A1 | 5/2016 |

OTHER PUBLICATIONS

Russian Office Action and Search Report dated Feb. 14, 2020, for Russian Application No. 2019122160, with English translation.

International Preliminary Report on Patentability and English translation of the Written Opinion of the International Searching Authority (Forms PCT/IB/338, PCT/IB/373, and PCT/ISA/237) for corresponding International Application No. PCT/JP2017/001360, dated Aug. 1, 2019.

* cited by examiner

HOT STAMPED PART AND MANUFACTURING METHOD THEREOF

TECHNICAL FIELD

The present invention relates to a hot stamped part and a manufacturing method thereof.

BACKGROUND ART

Conventionally, from the viewpoints of global environmental problems and collision safety performance, automobile structural parts have been required to be thinner and to have higher strength. In order to respond to these requirements, the automobile structural parts for each of which a high-strength steel sheet is used as a raw material have been increasing. Further, as a forming method of the high-strength steel sheet, a method referred to as hot stamping has been known. In the hot stamping, a steel sheet having the C content of about 0.20 mass % to 0.22 mass % is subjected to press forming in a high-temperature region of 700° C. or higher and subjected to quenching in a press die or out the press die. The hot stamping makes it possible to suppress such poor forming as occurs in a cold press because forming is performed in the high-temperature region where strength of the steel sheet decreases. Further, because a structure having martensite as a main phase can be obtained by quenching after forming, the high strength can be obtained. For this reason, a hot stamped part having a tensile strength of about 1500 MPa has been widely used worldwide.

However, when the present inventors have conducted a study for further higher strength, it has become clear that a low-stress fracture sometimes occurs in a hot stamped part having a tensile strength of 1900 MPa or more. When the hot stamped part in which the low-stress fracture occurs is used for the automobile structural parts, there is a possibility that the parts are fractured even in a case of receiving an impact calculated which the parts can resist in a design stage. Accordingly, suppression of the low-stress fracture is very important for securing collision safety of the automobile structural parts. Hitherto, a low-stress fracture of maraging steel has been known, but the low-stress fracture of the hot stamped part has not been known.

CITATION LIST

Patent Literature

Patent Literature 1: Japanese Laid-open Patent Publication No. 2012-41613

Patent Literature 2: Japanese Laid-open Patent Publication No. 2014-156653

Patent Literature 3: Japanese Patent No. 5756773

Patent Literature 4: Japanese Laid-open Patent Publication No. 2014-118613

Patent Literature 5: Japanese Patent No. 5402191

Non Patent Literature

Non Patent Literature 1: KAWABE Yoshikuni: Tetsu-To-Hagane, 68, (1982), 2595

SUMMARY OF INVENTION

Technical Problem

An object of the present invention is to provide a hot stamped part having high strength and being capable of suppressing a low-stress fracture and a manufacturing method thereof.

Solution to Problem

The present inventors have conducted a study in order to make a cause of occurrence of a low-stress fracture in a hot stamped part having a tensile strength of 1900 MPa or more clear.

Here, an index regarding a low-stress fracture in the present application will be explained. In the present application, when a tensile test piece in conformity to JIS Z 2201 is used and a tensile test is performed under the condition in conformity to JIS Z 2241, a material in which a rupture occurs before the following formula 1 is satisfied means a material in which a low-stress fracture occurs, and a material in which a rupture occurs after the formula 1 is satisfied means a material in which a low-stress fracture does not occur. In the formula 1, δ represents a true stress and ε represents a true strain.

$$d\delta/d\varepsilon=\delta \quad \text{(formula 1)}$$

The formula 1 is a maximum load condition derived from a constant volume law during deformation. Normally, dδ/dε is larger than δ immediately after starting the tensile test, and dδ/dε becomes smaller and δ becomes larger as the deformation progresses. Then, in the material in which the low-stress fracture does not occur, a load becomes maximum the moment dδ/dε is equal to δ, and a restriction occurs in the tensile test piece subsequently thereto, so that the load is reduced. On the other hand, in the material in which the low-stress fracture occurs, before the restriction occurs in the tensile test piece, namely, in a stage in which dδ/dε is larger than δ, a rupture occurs.

In the above-described study, first, the present inventors have investigated a relationship between a structure and the low-stress fracture of the hot stamped part. As a result, it has become clear that the finer a prior γ grain is and the fewer a coarse carbide is, the more unlikely it is that the low-stress fracture occurs.

However, conventional hot stamping makes it difficult that miniaturization of the prior γ grain and a reduction in the coarse carbide are compatible with each other, and makes it impossible to suppress the low-stress fracture and sufficiently improve a rupture property. That is, for the miniaturization of the prior γ grain, decreases in heating temperature and heating time in hot stamping are preferable, but the decreases in heating temperature and heating time lead to a reduction in an amount of dissolution of carbides during heating, and coarse carbides are likely to remain. Conversely, for the reduction in the coarse carbide, increases in heating temperature and heating time in hot stamping are preferable, but the increases in heating temperature and heating time lead to coarse prior γ grains.

Thus, in order that the miniaturization of the prior γ grain and the reduction in the coarse carbide of the hot stamped part are compatible with each other, the present inventors have studied an improvement in a structure of a steel sheet to be supplied for the hot stamping. As a result, it has become clear that in order to make the coarse carbides unlikely to remain, ferrite and pearlite likely to contain the coarse carbides are preferably reduced by setting fresh martensite and tempered martensite as a main phase, and that in order to obtain fine γ during heating for the hot stamping, carbides to become nucleation sites of a reverse transformation to γ are preferably dispersed finely in the steel sheet. By hot stamping a steel sheet having such a structure as described above, a hot stamped part very excellent in rupture property has been able to be obtained. However, such a steel sheet has the following problem.

The hardness of the steel sheet whose main phase is fresh martensite and tempered martensite is almost the same as the hardness after hot stamping, namely, the hardness of the hot stamped part. A Vickers hardness of a hot stamped part having a tensile strength of 1900 MPa is about 550 Hv, so that when an attempt to obtain a hot stamped part having a tensile strength of 1900 MPa or more is made, a Vickers hardness of a steel sheet becomes about 550 Hv or more. When the hot stamped part is manufactured, in a case where the steel sheet is subjected to blanking by shear cutting, punching, or the like before hot stamping to be formed into a blank material, the blanking of the steel sheet having the Vickers hardness of 550 Hv or more is very difficult.

Thus, the present inventors have further conducted keen studies. As a result, the present inventors have appreciated that a hot stamped part having a new structure and including an excellent rupture property can be obtained by performing at least two-time quenching under predetermined conditions after blanking, and based on such an appreciation, have conceived embodiments of the invention to be indicated below.

(1)

A manufacturing method of a hot stamped part includes:

a step of forming a blank material from a steel sheet;

a step of performing a first quenching of the blank material; and a step of performing a second quenching of the blank material after the first quenching, wherein the step of performing the first quenching includes:

a step of heating the blank material to a first temperature of not lower than (Ac3 point—50)° C. nor higher than 1200° C. at an average heating rate of 2° C./sec or more; and a step of cooling the blank material from the first temperature to a second temperature of 250° C. or lower, wherein the step of performing the second quenching includes:

a step of heating the blank material from the second temperature to a third temperature of not lower than (Ac3 point—50)° C. nor higher than 1200° C. at an average heating rate of 2° C./sec or more; and a step of cooling the blank material from the third temperature to a fourth temperature of 250° C. or lower, and wherein forming of the blank material is performed in the first quenching or the second quenching or both of the above.

(2)

The manufacturing method of the hot stamped part according to (1), includes a step of holding at the first temperature for one second or longer between the step of heating to the first temperature and the step of cooling to the second temperature.

(3)

The manufacturing method of the hot stamped part according to (1) or (2), wherein the third temperature is not lower than (Ac3 point—50)° C. nor higher than 1000° C.

(4)

The manufacturing method of the hot stamped part according to any one of (1) to (3), wherein heating from the second temperature to the third temperature is performed at an average heating rate of 5° C./sec or more.

(5)

The manufacturing method of the hot stamped part according to any one of (1) to (4), includes a step of holding at the third temperature for not shorter than 0.1 seconds nor longer than 300 seconds between the step of heating to the third temperature and the step of cooling to the fourth temperature.

(6)

The manufacturing method of the hot stamped part according to any one of (1) to (5), wherein the step of performing the second quenching includes a step of cooling the blank material to a fifth temperature from 700° C. to Ms point—50° C. at an average cooling rate of 20° C./sec.

(7)

A hot stamped part includes a microstructure represented by an area fraction of fresh martensite and tempered martensite: 80% or more in total, a prior austenite grain diameter: 20 μm or less, and an average grain diameter of carbides: 0.5 μm or less.

(8)

The hot stamped part according to (7), wherein a C content is not less than 0.27 mass % nor more than 0.60 mass %.

(9)

The hot stamped part according to (7) or (8), wherein a Vickers hardness is 550 Hv or more.

Advantageous Effects of Invention

According to the present invention, it is possible to obtain a hot stamped part having high strength and being capable of suppressing a low-stress fracture.

DESCRIPTION OF EMBODIMENTS

Hereinafter, an embodiment of the present invention will be explained.

First, a microstructure of a hot stamped part according to an embodiment of the present invention will be explained. The hot stamped part according to this embodiment has a microstructure represented by an area fraction of fresh martensite and tempered martensite: 80% or more in total, a prior austenite grain diameter: 20 μm or less, and an average grain diameter of carbides: 0.5 μm or less. The hot stamped part is a formed body to be obtained through hot stamping.

(Area Fraction of Fresh Martensite and Tempered Martensite: 80% or More in Total)

Fresh martensite and tempered martensite contribute to an improvement in strength. When the area fraction of fresh martensite and tempered martensite is less than 80% in total, sufficient strength, for example, a tensile strength of 1900 MPa or more cannot be obtained. Accordingly, the area fraction of fresh martensite and tempered martensite is 80% or more in total. A mechanical property of materials depends on a volume fraction of a structure or a phase, but as long as a microstructure is isotropic, the volume fraction is equivalent to the area fraction. Then, the area fraction can be measured more simply than the volume fraction. Therefore, the area fraction is used in the present application.

(Prior Austenite Grain Diameter (prior γ Grain Diameter): 20 μm or Less)

The prior γ grain diameter is an average grain diameter of prior γ grains. When the prior γ grain diameter is more than 20 μm, sufficient fracture toughness cannot be obtained, and a low-stress fracture is likely to occur. Accordingly, the prior γ grain diameter is 20 μm or less. From the viewpoints of an improvement in the fracture toughness and suppression of the low-stress fracture, the prior γ grain diameter is preferably 15 μm or less, and more preferably 10 μm or less.

(Average Grain Diameter of Carbides: 0.5 μm or Less)

When the average grain diameter of carbides is more than 0.5 μm, the low-stress fracture in which a coarse carbide is a starting point is likely to occur. Accordingly, the average grain diameter of carbides is 0.5 μm or less. From the viewpoint of the suppression of the low-stress fracture, the average grain diameter of carbides is preferably 0.3 μm or less. The carbides include iron-based carbides such as cementite and an E carbide, and carbonitride.

A commonly-used microstructure includes, for example, ferrite, pearlite, upper bainite, lower bainite, retained austenite, fresh martensite or tempered martensite, or an arbitrary combination of these. Here, an example of a method of measuring an area fraction of each of these structures or phases will be explained.

In measurement of the area fraction of each of ferrite, pearlite, upper bainite, lower bainite and tempered martensite, a sample is taken from a steel sheet with a cross section parallel to a rolling direction and parallel to a thickness direction being an observation surface. Next, the observation surface is polished and nital etched, and a range from a depth of t/8 to a depth of 3t/8 from the steel sheet surface in setting a thickness of the steel sheet as t is observed at 5000-fold magnification by a field emission scanning electron microscope (FE-SEM). This method allows ferrite, pearlite, upper bainite, lower bainite, and tempered martensite to be identified. By making such an observation regarding ten visual fields, the area fraction of each of ferrite, pearlite, upper bainite, lower bainite, and tempered martensite can be obtained from an average value of the ten visual fields. As described later, upper bainite, lower bainite and tempered martensite can be distinguished from one another by presence/absence and an extending direction of an iron-based carbide in a lath-shaped crystal grain.

Upper bainite is an aggregation of lath-shaped crystal grains and contains carbides between laths. Lower bainite is an aggregation of lath-shaped crystal grains and contains iron-based carbides each having a major axis of 5 nm or more in the inside thereof. The iron-based carbides contained in lower bainite have a single variant, and the iron-based carbides existing in one crystal grain extend substantially in a single direction. "Substantially single direction" mentioned here means a direction having an angular difference within 5°. Tempered martensite is an aggregation of lath-shaped crystal grains and contains iron-based carbides each having a major axis of 5 nm or more in the inside thereof. However, differently from lower bainite, the iron-based carbides contained in tempered martensite have a plurality of variants, and the iron-based carbides existing in one crystal grain extend in a plurality of directions. Accordingly, tempered martensite and lower bainite can be distinguished depending on whether the direction in which the iron-based carbide extends is plural or single.

In measurement of the area fraction of retained austenite, a sample is taken from the steel sheet, a portion from the steel sheet surface to a depth of t/4 is subjected to chemical polishing, and X-ray diffraction intensity on a surface in a depth of t/4 from the steel sheet surface parallel to a rolled surface is measured. For example, an area fraction Sγ of retained austenite is represented by the following formula.

$$S\gamma=(I_{200f}+I_{220f}+I_{311f})/(I_{200b}+I_{211b})\times 100$$

($I_{200f}$, $I_{220f}$, $I_{311f}$ indicate intensities of diffraction peaks of (200), (220), and (311) of a face-centered cubic lattice (fcc) phase respectively, and $I_{200b}$ and $I_{211b}$ indicate intensities of diffraction peaks of (200) and (211) of a body-centered cubic lattice (bcc) phase respectively.)

Fresh martensite and retained austenite are not sufficiently corroded by nital etching, and therefore, they can be distinguished from ferrite, pearlite, upper bainite, lower bainite and tempered martensite. Accordingly, the area fraction of fresh martensite can be specified by subtracting the area fraction Sγ of retained austenite from the area fraction of the balance in the FE-SEM observation.

Ferrite is a massive crystal grain, and does not contain a substructure such as lath in the inside thereof. Pearlite is a structure in which ferrite and cementite are alternately layered. For example, the layered ferrite in pearlite is distinguished from the above-described massive ferrite.

The grain diameter of carbide means a circle-equivalent diameter to be obtained from an area of the carbide measured in the observation surface of the sample. A density and a composition of the carbide can be measured by using, for example, a transmission electron microscope (TEM) or an atom probe field ion microscope (AP-FIM) with an analysis function according to energy dispersive X-ray spectrometry (EDX).

Next, a chemical composition of the steel sheet suitable for the hot stamped part and manufacture thereof according to the embodiment of the present invention will be explained. As described above, the hot stamped part according to the embodiment of the present invention is manufactured through blanking of the steel sheet and at least two-time quenching of a blank material. Accordingly, the chemical composition of the hot stamped part and the steel sheet is in consideration of not only properties of the hot stamped part but also these processes. In the following explanation, "%" which is a unit of a content of each of elements contained in the hot stamped part and the steel sheet means "mass %" unless otherwise stated. The hot stamped part according to this embodiment has a chemical composition represented by C: 0.27% to 0.60%, Mn: 0.50% to 5.00%, Si: 2.00% or less, P: 0.030% or less, S: 0.0100% or less, acid-soluble Al (sol. Al): 0.100% or less, N: 0.0100% or less, B: 0.0000% to 0.0050%, Cr: 0.00% to 0.50%, Mo: 0.00% to 0.50%, Ti: 0.000% to 0.100%, Nb: 0.000% to 0.100%, V: 0.000% to 0.100%, Cu: 0.000% to 1.000%, Ni: 0.000% to 1.000%, O: 0.00% to 0.02%, W: 0.0% to 0.1%, Ta: 0.0% to 0.1%, Sn: 0.00% to 0.05%, Sb: 0.00% to 0.05%, As: 0.00% to 0.05%, Mg: 0.00% to 0.05%, Ca: 0.00% to 0.05%, Y: 0.00% to 0.05%, Zr: 0.00% to 0.05%, La: 0.00% to 0.05%, or Ce: 0.00% to 0.05%, and the balance: Fe and impurities. As the impurities, the ones contained in raw materials such as ore and scrap and the ones contained in a manufacturing process are exemplified.

(C: 0.27% to 0.60%)

C is inexpensive and greatly contributes to an improvement in strength. When the C content is less than 0.27%, sufficient strength, for example, a strength of 1900 MPa or more is unlikely to be obtained unless an expensive element contains. Accordingly, the C content is preferably 0.27% or more, more preferably 0.35% or more, and further preferably 0.40% or more. On the other hand, when the C content is more than 0.60%, a hydrogen embrittlement property sometimes greatly deteriorates. Accordingly, the C content is preferably 0.60% or less.

(Mn: 0.50% to 5.00%)

Mn decreases Ac3 point to improve hardenability of the steel sheet. When the Mn content is less than 0.50%, sufficient hardenability cannot be sometimes obtained. Accordingly, the Mn content is preferably 0.50% or more, and more preferably 1.00% or more. On the other hand, when the Mn content is more than 5.00%, workability of the steel sheet before quenching sometimes deteriorates, and preforming before quenching sometimes becomes difficult. Further, a band-shaped structure caused by segregation of Mn is likely to occur, and toughness of the steel sheet sometimes deteriorates. Accordingly, the Mn content is preferably 5.00% or less.

(Si: 2.00% or Less)

Si is contained as an impurity in steel, for example. When the Si content is more than 2.00%, Ac3 point is excessively high, and heating for the quenching is to be performed at higher than 1200° C., or conversion treatability of the steel sheet and platability of galvanization sometimes decrease. Accordingly, the Si content is preferably 2.00% or less, and more preferably 1.00% or less. Because Si has action of enhancing the hardenability of the steel sheet, Si may be contained.

(P: 0.030% or Less)

P is contained as an impurity in steel, for example. P makes the workability of the steel sheet deteriorate, or makes toughness of the hot stamped part deteriorate. For this reason, the P content as low as possible is preferable. In particular, when the P content is more than 0.030%, decreases in the workability and the toughness are remarkable. Accordingly, the P content is preferably 0.030% or less.

(S: 0.0100% or Less)

S is contained as an impurity in steel, for example. S makes formability of the steel sheet deteriorate, or makes the toughness of the hot stamped part deteriorate. For this reason, the S content as low as possible is preferable. In particular, when the S content is more than 0.0100%, decreases in the formability and the toughness are remarkable. Accordingly, the S content is preferably 0.0100% or less, and more preferably 0.0050% or less.

(sol. Al: 0.100% or Less)

Sol. Al is contained as an impurity in steel, for example. When the sol. Al content is more than 0.100%, Ac3 point is excessively high, and the heating for the quenching is sometimes to be performed at higher than 1200° C. Accordingly, the sol. Al content is preferably 0.100% or less. Because sol. Al has action of making steel sounder by deoxidation, sol. Al may be contained.

(N: 0.0100% or Less)

N is contained as an impurity in steel, for example. N makes formability of the steel sheet deteriorate. For this reason, the N content as low as possible is preferable. In particular, when the N content is more than 0.0100%, the decrease in the formability is remarkable. Accordingly, the N content is preferably 0.0100% or less.

B, Cr, Mo, Ti, Nb, V, Cu and Ni are optional elements which may be each contained appropriately in the hot stamped part and the steel sheet within a limit of a predetermined amount.

(B: 0.0000% to 0.0050%)

B improves the hardenability of the steel sheet. Accordingly, B may be contained. In order to obtain this effect sufficiently, the B content is preferably 0.0001% or more. On the other hand, when the B content is more than 0.0050%, the effect by the above-described action is saturated, resulting in being disadvantage in terms of costs. Accordingly, the B content is preferably 0.005% or less.

(Cr: 0.00% to 0.50%)

Cr improves the hardenability of the steel sheet. Accordingly, Cr may be contained. In order to obtain this effect sufficiently, the Cr content is preferably 0.18% or more. On the other hand, when the Cr content is more than 0.50%, the workability of the steel sheet before quenching sometimes deteriorates, and the preforming before quenching sometimes becomes difficult. Accordingly, the Cr content is preferably 0.50% or less.

(Mo: 0.00% to 0.50%)

Mo improves the hardenability of the steel sheet. Accordingly, Mo may be contained. In order to obtain this effect sufficiently, the Mo content is preferably 0.03% or more. On the other hand, when the Mo content is more than 0.50%, the workability of the steel sheet before quenching sometimes deteriorates, and the preforming before quenching sometimes becomes difficult. Accordingly, the Mo content is preferably 0.50% or less.

(Ti: 0.000% to 0.100%, Nb: 0.000% to 0.100%, V: 0.000% to 0.100%)

Ti, Nb and V are strengthening elements, and contribute to a rise in strength of the steel sheet by precipitate strengthening, fine grain strengthening by growth suppression of ferrite crystal grains, and dislocation strengthening through suppression of recrystallization. In order to obtain this effect sufficiently, any of the Ti content, the Nb content and the V content is preferably 0.01% or more. On the other hand, when the Ti content, the Nb content or the V content is more than 0.100%, precipitation of carbonitrides increases, and the formability sometimes deteriorates. Accordingly, any of the Ti content, the Nb content and the V content is preferably 0.100% or less.

(Cu: 0.000% to 1.000%, Ni: 0.000% to 1.000%)

Cu and Ni contribute to the improvement in strength. In order to obtain this effect sufficiently, either of the Cu content and the Ni content is preferably 0.01% or more. On the other hand, when the Cu content or the Ni content is more than 1.000%, and picklability, weldability, hot workability, and the like sometimes deteriorate. Accordingly, either of the Cu content and the Ni content is preferably 1.000% or less.

That is, B: 0.0000% to 0.0050%, Cr: 0.00% to 0.50%, Mo: 0.00% to 0.50%, Ti: 0.000% to 0.100%, Nb: 0.000% to 0.100%, V: 0.000% to 0.100%, Cu: 0.000% to 1.000%, or Ni: 0.000% to 1.000%, or an arbitrary combination of these is preferably established.

In the hot stamped part and the steel sheet, the following elements may be each contained intentionally or inevitably within a limit of a predetermined amount. That is, O: 0.001% to 0.02%, W: 0.001% to 0.1%, Ta: 0.001% to 0.1%, Sn: 0.001% to 0.05%, Sb: 0.001% to 0.05%, As: 0.001% to 0.05%, Mg: 0.0001% to 0.05%, Ca: 0.001% to 0.05%, Y: 0.001% to 0.05%, Zr: 0.001% to 0.05%, La: 0.001% to 0.05%, or Ce: 0.001% to 0.05%, or an arbitrary combination of these may be established.

According to the embodiment of the present invention, it is possible to obtain a tensile strength of 1900 MPa or more, and to set a stress in which a fracture occurs to 1800 MPa or more even when a low-stress fracture occurs. Then, using this hot stamped part for automotive parts makes it possible to reduce a weight of a vehicle body with excellent collision safety obtained. For example, in a case where the automotive part for which a steel sheet having a tensile strength of about 500 MPa is used is replaced with the part made of the hot stamped part having a tensile strength of about 2500 MPa, when it is assumed that collision safety is a neck property of sheet thickness and the collision safety is in proportion to sheet thickness and steel sheet strength, the tensile strength becomes five times stronger, thereby allowing the sheet thickness to be reduced to ⅕. This sheet thickness reduction brings an enormous effect to a reduction in weight and an improvement in fuel consumption of an automobile.

Next, a manufacturing method of the hot stamped part according to the embodiment of the present invention will be explained. In the manufacturing method of the hot stamped part according to the embodiment of the present invention, a blank material is formed from the steel sheet having the above-described chemical composition, this blank material is subjected to at least two-time quenching, and forming of the blank material is performed in one or both of the two-time quenching.

A first quenching (a first heat treatment) is performed mainly so as to set the average grain diameter of carbides in the hot stamped part to 0.5 μm or less. For this reason, in the microstructure of the steel sheet after the first heat treatment, it is preferable that proportions of bainite, fresh martensite and tempered martensite likely to contain fine carbides are high, and proportions of ferrite and pearlite likely to contain coarse carbides are low. Concretely, a total area fraction of bainite, fresh martensite and tempered martensite is preferably 80% or more. Bainite, fresh martensite and tempered martensite are also each referred to as a low-temperature transformation structure, and the microstructure containing these by 80% or more is very fine. As long as the microstructure after the first heat treatment is fine, the microstructure after a second quenching (a second heat treatment) is also likely to be fine, and the low-stress fracture is likely to be suppressed. A number density of carbides in the steel sheet after the first heat treatment is preferably 0.50 pieces/$\mu m^2$ or more. This is because the carbides to become nucleation sites of a reverse transformation to γ are dispersed finely during heating in the second heat treatment, and the prior γ grain diameter after the second heat treatment (the prior γ grain diameter in the hot stamped part) is likely to be 20 μm or less. Further, the average grain diameter of carbides in the steel sheet after the first heat treatment is also preferably small so that the average grain diameter of carbides in the hot stamped part is likely to be 0.5 μm or less.

(Formation of Blank Material)

The steel sheet is subjected to blanking by shear cutting, punching, or the like to be formed into the blank material. The Vickers hardness of the steel sheet to be used in this embodiment is, for example, 500 Hv or less, and preferably 450 Hv or less. As long as the Vickers hardness is 500 Hv or less, the blanking can be easily performed. Further, according to this embodiment, even though the Vickers hardness of the steel sheet is 500 Hv or less, the sufficient strength, for example, the tensile strength of 1900 MPa or more can be obtained.

(First Quenching (First Heat Treatment))

In the first heat treatment, the blank material is heated to a first temperature of not lower than (Ac3 point—50)° C. nor higher than 1200° C., at an average heating rate of 2° C./sec or more, and the blank material is cooled from the first temperature to a second temperature of 250° C. or lower.

When the first temperature is lower than (Ac3 point—50° C.), the carbides in the blank material do not sufficiently melt, and it is difficult to set the average grain diameter of carbides in the hot stamped part to 0.5 μm or less. Accordingly, the first temperature is (Ac3 point—50° C.), preferably 900° C. or higher, and more preferably 1000° C. or higher. On the other hand, when the first temperature is higher than 1200° C., the effect is saturated, and the costs required for heating only increase. Accordingly, the first temperature is 1200° C. or lower.

When the average heating rate to the first temperature is less than 2° C./sec, the prior γ grains become coarse during the temperature increase, and it is difficult to set the prior γ grain diameter in the hot stamped part to 20 μm or less even though the second quenching is performed. Accordingly, the average heating rate to the first temperature is 2° C./sec or more, preferably 5° C./sec or more, more preferably 10° C./sec or more, and further preferably 100° C./sec or more. A heating method is not particularly limited, and for example, there are exemplified atmosphere heating, electric heating, and infrared heating.

Time holding for one second or longer is preferably performed at the first temperature. When a holding time is shorter than one second, the carbides do not sometimes sufficiently melt. Accordingly, the holding time is preferably one second or longer, and more preferably 100 seconds or longer. On the other hand, when the holding time is longer than 600 seconds, the effect is saturated, productivity is reduced, and costs only increase. Accordingly, the holding time is preferably 600 seconds or shorter.

When the second temperature being a cooling stop temperature is higher than 250° C., ferrite and pearlite likely to contain coarse carbides are likely to be generated, and the low-temperature transformation structures likely to contain fine carbides are unlikely to be generated. Accordingly, the second temperature is 250° C. or lower.

During cooling from the first temperature to the second temperature, an average cooling rate is preferably 10° C./sec or more in a temperature zone from 700° C. to 500° C. This is for avoiding a ferrite transformation and a pearlite transformation.

In a temperature zone from the first temperature to 700° C., air cooling accompanying transportation of the blank material may be performed. A cooling method is not particularly limited, and for example, gas cooling and water cooling are exemplified. When the gas cooling or the water cooling is performed, tension is preferably imparted to the blank material so as not to deform the blank material due to thermal stress. The blank material may be cooled by heat removal from a die after pressing with the die. The blank material may be cooled by spraying water on the blank material in the die. When the cooling is performed in the die, the blank material may be pressed with a flat die to finish the first heat treatment in a state of a flat sheet, or the blank material may be pressed with a die having a shape of the hot stamped part during the first heat treatment. The first heat treatment and the second heat treatment may be divided into two stages, to machine the blank material into the shape of the hot stamped part.

Note that Ac3 point (° C.) can be calculated by the following expression. Here, [X] indicates the content (mass %) of an element X.

$$Ac3\ \text{point} = 910 - 203\sqrt{[C]} - 30[Mn] - 11[Cr] + 44.7[Si] + 400[Al] + 700[P] - 15.2[Ni] - 20[Cu] + 400[Ti] + 104[V] + 31.5[Mo]$$

(Second Quenching (Second Heat Treatment))

In the second heat treatment, the blank material is heated from the second temperature to a third temperature of not lower than (Ac3 point—50)° C. nor higher than 1200° C. at an average heating rate of 2° C./sec or more, and the blank material is cooled from the third temperature to a fourth temperature of 250° C. or lower.

When the third temperature is lower than (Ac3 point—50° C.), the reverse transformation to γ falls short, and it is difficult to obtain sufficient tensile strength, for example, a tensile strength of 1900 MPa or more. Accordingly, the third temperature is (Ac3 point—50° C.) or higher, preferably (Ac3 point—20° C.) or higher, and more preferably Ac3 point or higher. On the other hand, when the third temperature is higher than 1200° C., the prior γ grains become coarse, and it is difficult to set the prior γ grain diameter of the hot stamped part to 20 μm or less. Accordingly, the third temperature is 1200° C. or lower, preferably 1000° C. or lower, more preferably 900° C. or lower, and further preferably 850° C. or lower.

When the average heating rate to the third temperature is less than 2° C./sec, the prior γ grains become coarse during the temperature increase, and it is difficult to set the prior γ grain diameter of the hot stamped part to 20 μm or less. Accordingly, the average heating rate to the third temperature is 2° C./sec or more, preferably 5° C./sec or more, more preferably 10° C./sec or more, and further preferably 100° C./sec or more. A heating method is not particularly limited, and for example, there are exemplified atmosphere heating, electric heating, and infrared heating. As long as a shape of the blank material after the first heat treatment is a flat-sheet shape, the electric heating is the most preferable among the above-described three types. This is because the electric heating can achieve the highest heating rate. When forming is performed during the first heat treatment, the infrared heating is the most preferable among the above-described three types. This is because it is difficult to heat a formed blank material uniformly by the electric heating, and the infrared heating can achieve a higher heating rate than the atmosphere heating.

Time holding from 0.1 seconds to 300 seconds is preferably performed at the third temperature. When a holding time is shorter than 0.1 seconds, the reverse transformation to γ falls short, and it is sometimes difficult to obtain the sufficient tensile strength, for example, the tensile strength of 1900 MPa or more. Accordingly, the holding time is preferably 0.1 seconds or longer. On the other hand, when the holding time is 300 seconds or longer, the prior γ grains become coarse, and it is sometimes difficult to set the prior γ grain diameter of the hot stamped part to 20 μm or less. Accordingly, the holding time is preferably 300 seconds or shorter, and more preferably 30 seconds or shorter.

When the fourth temperature being a cooling stop temperature is higher than 250° C., the quenching is insufficient, and martensite of the hot stamped part falls short. Accordingly, the fourth temperature is 250° C. or lower, and preferably Ms point (° C.)—50° C. or lower.

During cooling to the fourth temperature, an average cooling rate is preferably 20° C./sec or more in a temperature zone from 700° C. to Ms point—50° C. When the average cooling rate in the temperature zone from 700° C. to Ms point—50° C. is less than 20° C./sec, a ferrite transformation, a pearlite transformation or a bainite transformation occurs, and the area fraction of fresh martensite and tempered martensite is sometimes less than 80% in total. Accordingly, the average cooling rate in the temperature zone from 700° C. to Ms point—50° C. is preferably 20° C./sec or more.

Note that Ms point (° C.) can be calculated by the following expression. Here, [X] indicates the content (mass %) of an element X.

$$Ms\ \text{point} = 539 - 423[C] - 30.4[Mn] - 17.7[Ni] - 12.1[Cr] - 7.5[Mo]$$

An upper limit of a cooling rate from the third temperature to the fourth temperature is not limited, but it is common that the cooling rate is industrially 2000° C./sec or less even though a special device for cooling is used. The cooling rate is, roughly, 1000° C./sec or less in simple water cooling and 500° C./sec or less in simple die cooling. An upper limit of a cooling rate in cooling from the first temperature to the second temperature is also similar.

The cooling of the blank material from the third temperature to the fourth temperature is performed in the die. The blank material may be cooled by heat removal from the die, or the blank material may be cooled by spraying water on the blank material in the die.

Thus, the hot stamped part according to the embodiment of the present invention can be manufactured.

After taking the hot stamped part from the die, the hot stamped part may be heated within 6 hours at a temperature of 50° C. to 650° C. When the temperature of this heating is 50° C. to 400° C., fine carbides precipitate into martensite during the heating, and the delayed fracture resistance and the hydrogen embrittlement property improves. When the temperature of this heating is 400° C. to 650° C., alloy carbides or intermetallic compounds, or both of these precipitate during the heating, and the strength is increased by particle dispersion strengthening.

A time from finishing the first quenching to starting the second quenching is not particularly limited, but there is a possibility that depending on the composition of the blank material, fine carbides in the blank material grow due to long-time room-temperature holding, and the average grain diameter of carbides after the second quenching becomes large. For this reason, the above-described time is preferably within one month, more preferably within one week, and further preferably within one day.

The first quenching or the second quenching, or both of these may be repeated twice or more. The larger the number of times of quenching is, the smaller the prior γ grain diameter of the hot stamped part is likely to be. As described above, in a case where the prior γ grain diameter is preferably 15 μm or less, and more preferably 10 μm or less, the larger the number of times of quenching is, the more likely the prior γ grain diameter of 15 μm or less or 10 μm or less is to be obtained.

Next, an example of a manufacturing method of the steel sheet suitable for the manufacture of the hot stamped part will be explained. As the steel sheet suitable for the manufacture of the hot stamped part, any of a hot-rolled steel sheet not subjected to annealing, a hot-rolled annealed steel sheet obtained by subjecting the hot-rolled steel sheet to the annealing, a cold-rolled steel sheet obtained by subjecting the hot-rolled steel sheet or the hot-rolled annealed steel sheet to cold rolling and remaining cold-rolled, and a cold-rolled annealed steel sheet obtained by subjecting the cold-rolled steel sheet to the annealing is applicable.

In this example, first, the steel having the above-described chemical composition is refined by a conventional means, and the slab is obtained by continuous casting. It is possible to obtain a steel ingot by casting the steel and obtain a steel billet by subjecting the steel ingot to bloom rolling. From the viewpoint of productivity, the continuous casting is preferable.

A casting speed of the continuous casting is preferably set to less than 2.0 m/min in order to effectively suppress central segregation and V-shaped segregation of Mn. Further, in order to keep cleanliness on a surface of the slab good and secure the productivity, the casting speed is preferably set to 1.2 m/min or more.

Next, the slab or the steel billet is subjected to the hot rolling. In the hot rolling, it is preferable to set a slab heating temperature to 1100° C. or higher and set a finishing temperature to 850° C. or higher for solution of an inclusion. It is preferable to set a coiling temperature to 500° C. or higher from the viewpoint of the workability, and set it to 650° C. or less from the viewpoint of suppression of a reduction in yield due to generation of scale.

Thereafter, the hot-rolled steel sheet obtained by the hot rolling is subjected to descaling treatment by pickling or the like. The hot-rolled steel sheet after the descaling treatment can be used for the manufacture of the hot stamped part.

The hot-rolled steel sheet may be subjected to hot-rolled sheet annealing after the descaling treatment. The hot-rolled annealed steel sheet obtained by the hot-rolled sheet annealing can also be used for the manufacture of the hot stamped part.

The hot-rolled annealed steel sheet may be subjected to the cold rolling after the hot-rolled sheet annealing. The cold-rolled steel sheet obtained by the cold rolling can be used for the manufacture of the hot stamped part. When the hot-rolled annealed steel sheet is hard, the workability is preferably enhanced by performing the annealing before the cold rolling. It is sufficient that the cold rolling is performed by a conventional means. A reduction ratio in the cold rolling is preferably set to 30% or more from the viewpoint of securing good flatness, and preferably set to 80% or less in order to avoid becoming an excessive load.

The cold-rolled steel sheet may be subjected to the cold-rolled sheet annealing. The cold-rolled annealed steel sheet obtained by the cold-rolled sheet annealing can be used for the manufacture of the hot stamped part.

In the hot-rolled sheet annealing and the cold-rolled sheet annealing, the annealing may be performed after performing treatment of degreasing or the like in accordance with a conventional means as necessary. From the viewpoint of uniformizing the microstructure and the viewpoint of the productivity, the annealing is preferably performed in a continuous annealing line. When the annealing is performed in the continuous annealing line, soaking is preferably performed in a time of not shorter than 1 second nor longer than 1000 seconds in a temperature zone of not lower than Ac3 point nor higher than (Ac3 point+100° C.), and subsequently, holding is preferably performed for not shorter than 1 minute nor longer than 30 minutes in a temperature zone of not lower than 250° C. nor higher than 550° C.

The hot-rolled steel sheet, the hot-rolled annealed steel sheet, the cold-rolled steel sheet or the cold-rolled annealed steel sheet may be subjected to plating. When zinc-based plating is preferably performed as the plating, hot-dip zinc-based plating is preferably performed in a continuous hot-dip galvanizing line from the viewpoint of the productivity. In the above case, annealing may be performed previously to the hot-dip zinc-based plating in the continuous hot-dip galvanizing line, or the zinc-based plating may be performed without performing the annealing while setting soaking temperature to be at low temperatures. Alloying treatment may be performed after the hot-dip zinc-based plating to produce an alloyed hot-dip galvanized steel sheet. The zinc-based plating may be performed by electroplating. As examples of the zinc-based plating, there are exemplified hot-dip galvanizing, alloying hot-dip galvanizing, electrogalvanizing, hot-dip zinc-aluminum alloy plating, electric nickel-zinc alloy plating and electric iron-zinc alloy plating. An adhesion amount for the plating is not particularly limited, and it is sufficient that it is nearly equal to an adhesion amount to a conventional plated steel sheet. The zinc-based plating can be performed on at least a part of a surface of a steel material, but generally, the zinc-based plating of a steel sheet is performed on a single surface of the steel sheet or over both surfaces thereof.

Note that the above-described embodiment merely illustrates concrete examples of implementing the present invention, and the technical scope of the present invention is not to be construed in a restrictive manner by these embodiments. That is, the present invention may be implemented in various forms without departing from the technical spirit or main features thereof.

EXAMPLE

Next, examples of the present invention will be explained. Conditions in examples are condition examples employed for confirming the applicability and effects of the present invention and the present invention is not limited to these examples. The present invention can employ various conditions as long as the object of the present invention is achieved without departing from the spirit of the present invention.

(First Experiment)

Slabs having chemical compositions presented in Table 1 were subjected to hot-rolling. In the hot rolling, a slab heating temperature was set to 1250° C., a finishing temperature was set to 930° C., and a coiling temperature was set to 650° C. In cooling from the finishing temperature (930° C.) to the coiling temperature (650° C.), an average cooling rate was set to 20° C./sec. Thus, hot-rolled steel sheets each having a thickness of 1.6 mm or 3.2 mm were obtained. Next, the hot-rolled steel sheets were subjected to descaling treatment. The balance of each of the chemical compositions presented in Table 1 is Fe and impurities.

TABLE 1

| MARK OF STEEL | CHEMICAL COMPOSITION (MASS %) | | | | | | | | | | | | | Ac3 POINT (° C.) | Ar3 POINT (° C.) | Ms POINT (° C.) |
|---|---|---|---|---|---|---|---|---|---|---|---|---|---|---|---|---|
| | C | Si | Al | Mn | P | S | N | Cr | B | Ti | Ni | Nb | Mo | | | |
| a | 0.25 | 0.30 | 0.030 | 3.20 | 0.006 | 0.0016 | 0.0016 | | | | | | | 733 | 535 | 336 |
| b | 0.27 | 0.32 | 0.029 | 1.63 | 0.022 | 0.0003 | 0.0034 | 0.10 | 0.0021 | 0.040 | | | | 803 | 669 | 374 |
| c | 0.30 | 0.52 | 0.040 | 2.33 | 0.028 | 0.0022 | 0.0026 | 0.30 | | 0.050 | 0.730 | | | 794 | 559 | 325 |
| d | 0.36 | 0.63 | 0.062 | 1.59 | 0.006 | 0.0037 | 0.0039 | 0.41 | 0.0010 | | | 0.084 | | 784 | 640 | 333 |
| e | 0.40 | 0.82 | 0.085 | 1.62 | 0.012 | 0.0027 | 0.0031 | 0.20 | | | 0.890 | | 0.38 | 811 | 581 | 300 |
| f | 0.46 | 1.30 | 0.016 | 0.66 | 0.016 | 0.0330 | 0.0024 | 0.42 | | | | 0.055 | 0.49 | 829 | 692 | 316 |
| g | 0.59 | 0.22 | 0.061 | 2.30 | 0.006 | 0.0016 | 0.0016 | | 0.0021 | 0.040 | | 0.055 | 0.38 | 742 | 487 | 217 |

Thereafter, from the hot-rolled steel sheets each having a thickness of 3.2 mm, as follows, cold-rolled steel sheets, aluminum-plated steel sheets, hot-dip galvanized steel sheets, and alloyed hot-dip galvanized steel sheets were produced. First, the hot-rolled steel sheets each having a thickness of 3.2 mm were subjected to the hot-rolled sheet annealing at 600° C. for two hours and subjected to the cold rolling at a reduction ratio of 50% to obtain the cold-rolled steel sheets each having a thickness of 1.6 mm. Next, the partial cold-rolled steel sheets were subjected to the annealing in continuous hot-dip annealing equipment or continuous aluminizing line. In this annealing, after holding the cold-rolled steel sheets at 800° C. for 120 seconds, holding was performed at 400° C. for 200 seconds. After the annealing, the cold-rolled steel sheets were subjected to aluminum coating layer, hot-dip galvanizing, or alloying hot-dip galvanizing at a temperature of 500° C. or lower. Thus, as steel sheets for hot stamping, the hot-rolled steel sheets, the cold-rolled steel sheets, the aluminum-plated steel sheets, the hot-dip galvanized steel sheets, and the alloyed hot-dip galvanized steel sheets were prepared.

Thereafter, the steel sheets for hot stamping were subjected to blanking to be formed into blank materials, and a first quenching (first heat treatment) and a second quenching (second heat treatment) of the blank materials were performed. Table 2 and Table 3 present conditions of the first heat treatment and conditions of the second heat treatment. Note that in the first heat treatment, atmosphere heating, air cooling from a holding temperature to 700° C., and cooling at an average cooling rate of 50° C./sec in a flat sheet-shaped die from 700° C. to a cooling stop temperature were performed. In the second heat treatment, atmosphere heating was performed when a heating rate was 50° C./sec or less, and electric heating was performed when it was more than 50° C./sec. Air cooling from a holding temperature to 700° C., and cooling at an average cooling rate of 100° C./s while performing press forming in a die from 700° C. to a cooling stop temperature were performed. Thus, various hot stamped parts were manufactured. Underlines in Table 2 and Table 3 indicate that numerical values thereon deviate from ranges of the present invention.

TABLE 2

| | | | FIRST QUENCHING (FIRST HEAT TREATMENT) | | | | | SECOND QUENCHING (SECOND HEAT TREATMENT) | | | | |
|---|---|---|---|---|---|---|---|---|---|---|---|---|
| TEST No. | MARK OF STEEL | STEEL TYPE | AVERAGE HEATING RATE (° C./sec) | Ac3 POINT (° C.) | HOLDING TEMPERATURE (° C.) | HOLDING TIME (sec) | COOLING STOP TEMPERATURE (° C.) | AVERAGE HEATING RATE (° C./sec) | HOLDING TEMPERATURE (° C.) | HOLDING TIME (sec) | COOLING STOP TEMPERATURE (° C.) | REMARK |
| 1 | a | COLD-ROLLED STEEL SHEET | 5 | 733 | 650 | 100 | 250 | 100 | 1000 | 10 | 200 | COMPARATVE EXAMPLE |
| 2 | b | COLD-ROLLED STEEL SHEET | 10 | 803 | 900 | 10 | 250 | 10 | 930 | 10 | 200 | INVENTION EXAMPLE |
| 3 | c | COLD-ROLLED STEEL SHEET | 10 | 794 | 900 | 10 | 250 | 10 | 930 | 10 | 200 | INVENTION EXAMPLE |
| 4 | d | COLD-ROLLED STEEL SHEET | 10 | 784 | 900 | 10 | 250 | 10 | 930 | 10 | 200 | INVENTION EXAMPLE |
| 5 | e | COLD-ROLLED STEEL SHEET | 10 | 811 | 900 | 10 | 250 | 10 | 930 | 10 | 200 | INVENTION EXAMPLE |
| 6 | f | COLD-ROLLED STEEL SHEET | | | ABSENCE | | | 10 | 930 | 10 | 200 | COMPARATVE EXAMPLE |
| 7 | f | COLD-ROLLED STEEL SHEET | 20 | 829 | 900 | 10 | 650 | 10 | 930 | 10 | 200 | COMPARATVE EXAMPLE |
| 8 | f | COLD-ROLLED STEEL SHEET | 20 | 829 | 900 | 10 | 250 | 3 | 930 | 10 | 200 | INVENTION EXAMPLE |
| 9 | f | COLD-ROLLED STEEL SHEET | 20 | 829 | 900 | 10 | 250 | 10 | 930 | 500 | 200 | INVENTION EXAMPLE |
| 10 | f | COLD-ROLLED STEEL SHEET | 20 | 829 | 900 | 10 | 250 | 10 | 930 | 10 | 200 | INVENTION EXAMPLE |
| 11 | f | COLD-ROLLED STEEL SHEET | 20 | 829 | 1000 | 10 | 250 | 10 | 930 | 10 | 200 | INVENTION EXAMPLE |
| 12 | f | COLD-ROLLED STEEL SHEET | 20 | 829 | 900 | 100 | 250 | 10 | 930 | 10 | 200 | INVENTION EXAMPLE |
| 13 | f | COLD-ROLLED STEEL SHEET | 20 | 829 | 900 | 10 | 250 | 10 | 930 | 10 | 200 | INVENTION EXAMPLE |
| 14 | f | COLD-ROLLED STEEL SHEET | 20 | 829 | 900 | 10 | 250 | 300 | 930 | 10 | 200 | INVENTION EXAMPLE |
| 15 | f | COLD-ROLLED STEEL SHEET | 20 | 829 | 900 | 10 | 250 | 10 | 850 | 10 | 200 | INVENTION EXAMPLE |
| 16 | f | COLD-ROLLED STEEL SHEET | 20 | 829 | 900 | 10 | 250 | 300 | 930 | 0.1 | 200 | INVENTION EXAMPLE |
| 17 | f | COLD-ROLLED STEEL SHEET | 1 | 829 | 900 | 10 | 250 | 10 | 930 | 10 | 200 | COMPARATVE EXAMPLE |
| 18 | f | COLD-ROLLED STEEL SHEET | 20 | 829 | 750 | 10 | 250 | 10 | 930 | 10 | 200 | COMPARATVE EXAMPLE |
| 19 | f | COLD-ROLLED STEEL SHEET | 20 | 829 | 900 | 10 | 250 | 1 | 850 | 10 | 200 | COMPARATVE EXAMPLE |
| 20 | f | COLD-ROLLED STEEL SHEET | 20 | 829 | 900 | 10 | 250 | 10 | 850 | 10 | 270 | COMPARATVE EXAMPLE |
| 21 | f | COLD-ROLLED STEEL SHEET | 20 | 829 | 900 | 10 | 250 | 10 | 850 | 10 | 250 | INVENTION EXAMPLE |

TABLE 2-continued

| TEST No. | MARK OF STEEL | STEEL TYPE | FIRST QUENCHING (FIRST HEAT TREATMENT) AVERAGE HEATING RATE (° C./sec) | Ac3 POINT (° C.) | HOLDING TEMPERATURE (° C.) | HOLDING TIME (sec) | COOLING STOP TEMPERATURE (° C.) | SECOND QUENCHING (SECOND HEAT TREATMENT) AVERAGE HEATING RATE (° C./sec) | HOLDING TEMPERATURE (° C.) | HOLDING TIME (sec) | COOLING STOP TEMPERATURE (° C.) | REMARK |
|---|---|---|---|---|---|---|---|---|---|---|---|---|
| 22 | g | COLD-ROLLED STEEL SHEET | 20 | 742 | 900 | 10 | 250 | 10 | 930 | 10 | 200 | INVENTION EXAMPLE |
| 23 | a | HOT-ROLLED STEEL SHEET | 20 | 733 | 650 | 100 | 250 | 100 | 1000 | 10 | 200 | COMPARATVE EXAMPLE |
| 24 | b | HOT-ROLLED STEEL SHEET | 20 | 803 | 900 | 10 | 250 | 10 | 930 | 10 | 100 | INVENTION EXAMPLE |
| 25 | c | HOT-ROLLED STEEL SHEET | 20 | 794 | 900 | 10 | 250 | 10 | 930 | 10 | 100 | INVENTION EXAMPLE |
| 26 | d | HOT-ROLLED STEEL SHEET | 20 | 784 | 900 | 10 | 250 | 10 | 930 | 10 | 100 | INVENTION EXAMPLE |
| 27 | e | HOT-ROLLED STEEL SHEET | 20 | 811 | 900 | 10 | 250 | 10 | 930 | 10 | 100 | INVENTION EXAMPLE |
| 28 | f | HOT-ROLLED STEEL SHEET | 20 | 829 | 700 | 10 | 250 | 10 | 930 | 10 | 100 | COMPARATVE EXAMPLE |
| 29 | f | HOT-ROLLED STEEL SHEET | | | ABSENCE | | | 10 | 930 | 10 | 100 | COMPARATVE EXAMPLE |
| 30 | f | HOT-ROLLED STEEL SHEET | 30 | 829 | 900 | 10 | 250 | 10 | 1150 | 10 | 100 | INVENTION EXAMPLE |
| 31 | f | HOT-ROLLED STEEL SHEET | 30 | 829 | 900 | 100 | 250 | 10 | 930 | 10 | 100 | INVENTION EXAMPLE |
| 32 | f | HOT-ROLLED STEEL SHEET | 1 | 829 | 900 | 10 | 250 | 10 | 930 | 10 | 100 | COMPARATVE EXAMPLE |
| 33 | f | HOT-ROLLED STEEL SHEET | 30 | 829 | 900 | 10 | 270 | 10 | 930 | 10 | 100 | COMPARATVE EXAMPLE |
| 34 | f | HOT-ROLLED STEEL SHEET | 30 | 829 | 900 | 10 | 250 | 1 | 930 | 10 | 100 | COMPARATVE EXAMPLE |
| 35 | f | HOT-ROLLED STEEL SHEET | 30 | 829 | 900 | 10 | 250 | 10 | 930 | 10 | 270 | COMPARATVE EXAMPLE |
| 36 | f | HOT-ROLLED STEEL SHEET | 30 | 829 | 900 | 10 | 250 | 10 | 930 | 10 | 250 | INVENTION EXAMPLE |

TABLE 3

| TEST No. | MARK OF STEEL | STEEL TYPE | FIRST QUENCHING (FIRST HEAT TREATMENT) AVERAGE HEATING RATE (° C./sec) | Ac3 POINT (° C.) | HOLDING TEMPERATURE (° C.) | HOLDING TIME (sec) | COOLING STOP TEMPERATURE (° C.) | SECOND QUENCHING (SECOND HEAT TREATMENT) AVERAGE HEATING RATE (° C./sec) | HOLDING TEMPERATURE (° C.) | HOLDING TIME (sec) | COOLING STOP TEMPERATURE (° C.) | REMARK |
|---|---|---|---|---|---|---|---|---|---|---|---|---|
| 37 | f | ALUMINUM-PLATED STEEL SHEET | 30 | 829 | 900 | 10 | 250 | 10 | 930 | 10 | 100 | INVENTION EXAMPLE |
| 38 | f | ALUMINUM-PLATED STEEL SHEET | 30 | 829 | 1000 | 10 | 250 | 10 | 930 | 10 | 100 | INVENTION EXAMPLE |
| 39 | f | ALUMINUM-PLATED STEEL SHEET | 30 | 829 | 900 | 100 | 250 | 10 | 930 | 10 | 100 | INVENTION EXAMPLE |
| 40 | f | ALUMINUM-PLATED STEEL SHEET | 30 | 829 | 900 | 10 | 250 | 300 | 930 | 10 | 100 | INVENTION EXAMPLE |
| 41 | f | ALUMINUM-PLATED STEEL SHEET | 1 | 829 | 900 | 10 | 250 | 10 | 930 | 10 | 100 | COMPARATVE EXAMPLE |
| 42 | f | ALUMINUM-PLATED STEEL SHEET | 30 | 829 | 750 | 10 | 250 | 10 | 930 | 10 | 100 | COMPARATVE EXAMPLE |
| 43 | f | ALUMINUM-PLATED STEEL SHEET | 30 | 829 | 900 | 10 | 270 | 10 | 930 | 10 | 100 | COMPARATVE EXAMPLE |
| 44 | f | ALUMINUM-PLATED STEEL SHEET | 30 | 829 | 900 | 10 | 250 | 1 | 930 | 10 | 100 | COMPARATVE EXAMPLE |
| 45 | f | ALUMINUM-PLATED STEEL SHEET | 30 | 829 | 900 | 10 | 250 | 10 | 930 | 10 | 270 | COMPARATVE EXAMPLE |
| 46 | f | ALUMINUM-PLATED STEEL SHEET | 30 | 829 | 900 | 10 | 250 | 10 | 930 | 10 | 250 | INVENTION EXAMPLE |
| 47 | f | HOT-DIP GALVANIZED STEEL SHEET | 30 | 829 | 900 | 10 | 250 | 10 | 930 | 10 | 100 | INVENTION EXAMPLE |

TABLE 3-continued

| TEST No. | MARK OF STEEL | STEEL TYPE | FIRST QUENCHING (FIRST HEAT TREATMENT) AVERAGE HEATING RATE (° C./sec) | Ac3 POINT (° C.) | HOLDING TEMPERATURE (° C.) | HOLDING TIME (sec) | COOLING STOP TEMPERATURE (° C.) | SECOND QUENCHING (SECOND HEAT TREATMENT) AVERAGE HEATING RATE (° C./sec) | HOLDING TEMPERATURE (° C.) | HOLDING TIME (sec) | COOLING STOP TEMPERATURE (° C.) | REMARK |
|---|---|---|---|---|---|---|---|---|---|---|---|---|
| 48 | f | HOT-DIP GALVANIZED STEEL SHEET | 30 | 829 | 1000 | 10 | 250 | 10 | 930 | 10 | 100 | INVENTION EXAMPLE |
| 49 | f | HOT-DIP GALVANIZED STEEL SHEET | 30 | 829 | 900 | 100 | 250 | 10 | 930 | 10 | 100 | INVENTION EXAMPLE |
| 50 | f | HOT-DIP GALVANIZED STEEL SHEET | 30 | 829 | 900 | 10 | 250 | 300 | 930 | 10 | 100 | INVENTION EXAMPLE |
| 51 | f | HOT-DIP GALVANIZED STEEL SHEET | 1 | 829 | 900 | 10 | 250 | 10 | 930 | 10 | 100 | COMPARATVE EXAMPLE |
| 52 | f | HOT-DIP GALVANIZED STEEL SHEET | 30 | 829 | 750 | 10 | 250 | 10 | 930 | 10 | 100 | COMPARATVE EXAMPLE |
| 53 | f | HOT-DIP GALVANIZED STEEL SHEET | 30 | 829 | 900 | 10 | 270 | 10 | 930 | 10 | 100 | COMPARATVE EXAMPLE |
| 54 | f | HOT-DIP GALVANIZED STEEL SHEET | 30 | 829 | 900 | 10 | 250 | 1 | 930 | 10 | 100 | COMPARATVE EXAMPLE |
| 55 | f | HOT-DIP GALVANIZED STEEL SHEET | 30 | 829 | 900 | 10 | 250 | 10 | 930 | 10 | 270 | COMPARATVE EXAMPLE |
| 56 | f | HOT-DIP GALVANIZED STEEL SHEET | 30 | 829 | 900 | 10 | 250 | 10 | 930 | 10 | 250 | INVENTION EXAMPLE |
| 57 | e | ALLOYED HOT-DIP GALVANIZED STEEL SHEET | 30 | 811 | 900 | 10 | 250 | 10 | 930 | 10 | 50 | INVENTION EXAMPLE |
| 58 | f | ALLOYED HOT-DIP GALVANIZED STEEL SHEET | 30 | 829 | 900 | 10 | 250 | 10 | 930 | 10 | 50 | INVENTION EXAMPLE |
| 59 | f | ALLOYED HOT-DIP GALVANIZED STEEL SHEET | 30 | 829 | 1050 | 10 | 250 | 10 | 930 | 10 | 50 | INVENTION EXAMPLE |
| 60 | f | ALLOYED HOT-DIP GALVANIZED STEEL SHEET | 30 | 829 | 900 | 200 | 250 | 10 | 930 | 10 | 50 | INVENTION EXAMPLE |
| 61 | f | ALLOYED HOT-DIP GALVANIZED STEEL SHEET | 30 | 829 | 900 | 10 | 250 | 200 | 930 | 10 | 50 | INVENTION EXAMPLE |
| 62 | f | ALLOYED HOT-DIP GALVANIZED STEEL SHEET | 30 | 829 | 900 | 10 | 250 | 10 | 850 | 10 | 50 | INVENTION EXAMPLE |
| 63 | f | ALLOYED HOT-DIP GALVANIZED STEEL SHEET | 30 | 829 | 900 | 10 | 250 | 1000 | 850 | 0.1 | 50 | INVENTION EXAMPLE |
| 64 | f | ALLOYED HOT-DIP GALVANIZED STEEL SHEET | 1 | 829 | 900 | 10 | 250 | 10 | 930 | 10 | 50 | COMPARATVE EXAMPLE |
| 65 | f | ALLOYED HOT-DIP GALVANIZED STEEL SHEET | 30 | 829 | 750 | 10 | 250 | 10 | 930 | 10 | 50 | COMPARATVE EXAMPLE |
| 66 | f | ALLOYED HOT-DIP GALVANIZED STEEL SHEET | 30 | 829 | 900 | 10 | 270 | 10 | 930 | 10 | 50 | COMPARATVE EXAMPLE |
| 67 | f | ALLOYED HOT-DIP GALVANIZED STEEL SHEET | 30 | 829 | 900 | 10 | 250 | 1 | 930 | 10 | 50 | COMPARATVE EXAMPLE |
| 68 | f | ALLOYED HOT-DIP GALVANIZED STEEL SHEET | 30 | 829 | 900 | 10 | 250 | 10 | 930 | 10 | 270 | COMPARATVE EXAMPLE |
| 69 | f | ALLOYED HOT-DIP GALVANIZED STEEL SHEET | 30 | 829 | 900 | 10 | 250 | 10 | 930 | 10 | 250 | INVENTION EXAMPLE |
| 70 | g | ALLOYED HOT-DIP GALVANIZED STEEL SHEET | 30 | 742 | 900 | 10 | 250 | 10 | 930 | 10 | 50 | INVENTION EXAMPLE |

Microstructures before the second heat treatment after the first heat treatment and microstructures after the second heat treatment were observed. Table 4 and Table 5 present these results. An observation method of the microstructures is as described above. Further, tensile test pieces in conformity to JIS Z 2201 were taken from the hot stamped parts, and maximum tensile strength was measured by a tensile test in conformity to JIS Z 2241. The tensile test was performed five times for each test No., and an average value of five maximum tensile strengths was set as tensile strength of the test No. Table 4 and Table 5 also present this result. The reason why the average value is set as the tensile strength is that in a case where a low-stress fracture occurs, even though manufacturing conditions are the same, large variation in rupture stress is likely to occur. Regarding certain true strain $\varepsilon_a$ and true stress $\delta_a$, the low-stress fracture was judged as occurring regarding a sample in which a rupture occurred before the following formula 2 was satisfied, and the low-stress fracture was judged as not occurring regarding a sample in which a rupture occurred after the following formula 2 was satisfied. In the formula 2, $\Delta\varepsilon_a$ was set to 0.0002, and $\Delta\delta_a$ was set as a difference between "a true stress $\delta_{a+1}$ when a true strain is "$\varepsilon_a$+0.0002"" and "a true stress $\delta_a$ when a true strain is "$\varepsilon_a$"" ($\Delta\delta_a=\delta_{a+1}-\delta_a$), $$\Delta\delta_a/\Delta\varepsilon_a=\delta_a \quad \text{(formula 2).}$$

TABLE 4

| | | MICROSTRUCTURE AFTER FIRST QUENCHING | | | | | MICROSTRUCTURE AFTER SECOND QUENCHING | | | | | | | |
|---|---|---|---|---|---|---|---|---|---|---|---|---|---|---|
| | | AREA FRACTION (%) | | | | DENSITY OF CARBIDE (/μm²) | AREA FRACTION (%) | | | PRIOR γ GRAIN DIAMETER (μm) | AVERAGE GRAIN DIAMETER OF CARBIDE (μm) | MECHANICAL PROPERTY | | |
| TEST No. | MARK OF STEEL | TEMPERED MARTENSITE | FRESH MARTENSITE | BAINITE | TOTAL | | TEMPERED MARTENSITE | FRESH MARTENSITE | TOTAL | | | TENSILE STRENGTH (MPa) | LOW-STRESS FRACTURE | REMARK |
| 1 | a | 0 | 0 | 0 | 0 | 0.6 | 60 | 40 | 100 | 25 | 0.8 | 1680 | ABSENCE | COMPARATIVE EXAMPLE |
| 2 | b | 50 | 50 | 0 | 100 | 0.7 | 60 | 40 | 100 | 19 | 0.5 | 1910 | ABSENCE | INVENTION EXAMPLE |
| 3 | c | 50 | 50 | 0 | 100 | 0.7 | 60 | 40 | 100 | 19 | 0.5 | 2010 | ABSENCE | INVENTION EXAMPLE |
| 4 | d | 50 | 50 | 0 | 100 | 0.8 | 60 | 40 | 100 | 18 | 0.5 | 2370 | ABSENCE | INVENTION EXAMPLE |
| 5 | e | 45 | 55 | 0 | 100 | 0.6 | 55 | 45 | 100 | 18 | 0.5 | 2650 | ABSENCE | INVENTION EXAMPLE |
| 6 | f | 0 | 0 | 0 | 0 | 0.6 | 55 | 45 | 100 | 23 | 0.7 | 1210 | PRESENCE | COMPARATIVE EXAMPLE |
| 7 | f | 0 | 0 | 0 | 0 | 0.5 | 55 | 45 | 100 | 24 | 0.8 | 1160 | PRESENCE | COMPARATIVE EXAMPLE |
| 8 | f | 45 | 55 | 0 | 100 | 0.8 | 55 | 45 | 100 | 19 | 0.5 | 1970 | PRESENCE | INVENTION EXAMPLE |
| 9 | f | 45 | 55 | 0 | 100 | 0.8 | 55 | 45 | 100 | 19 | 0.3 | 1980 | PRESENCE | INVENTION EXAMPLE |
| 10 | f | 45 | 55 | 0 | 100 | 0.8 | 55 | 45 | 100 | 17 | 0.4 | 2130 | PRESENCE | INVENTION EXAMPLE |
| 11 | f | 45 | 55 | 0 | 100 | 0.8 | 55 | 45 | 100 | 17 | 0.3 | 2240 | PRESENCE | INVENTION EXAMPLE |
| 12 | f | 45 | 55 | 0 | 100 | 0.8 | 55 | 45 | 100 | 17 | 0.3 | 2250 | PRESENCE | INVENTION EXAMPLE |
| 13 | f | 45 | 55 | 0 | 100 | 0.8 | 55 | 45 | 100 | 14 | 0.4 | 2320 | PRESENCE | INVENTION EXAMPLE |
| 14 | f | 45 | 55 | 0 | 100 | 0.8 | 55 | 45 | 100 | 14 | 0.4 | 2330 | PRESENCE | INVENTION EXAMPLE |
| 15 | f | 45 | 55 | 0 | 100 | 0.7 | 55 | 45 | 100 | 13 | 0.4 | 2320 | PRESENCE | INVENTION EXAMPLE |
| 16 | f | 45 | 55 | 0 | 100 | 0.8 | 55 | 45 | 100 | 9 | 0.4 | 2710 | ABSENCE | INVENTION EXAMPLE |
| 17 | f | 45 | 55 | 0 | 100 | 0.8 | 60 | 40 | 100 | 23 | 0.4 | 1410 | PRESENCE | COMPARATIVE EXAMPLE |
| 18 | f | 0 | 0 | 0 | 0 | 0.6 | 60 | 40 | 100 | 22 | 0.7 | 1320 | PRESENCE | COMPARATIVE EXAMPLE |
| 19 | f | 50 | 50 | 0 | 100 | 0.7 | 65 | 35 | 100 | 25 | 0.5 | 1200 | PRESENCE | COMPARATIVE EXAMPLE |
| 20 | f | 45 | 55 | 0 | 100 | 0.7 | 40 | 0 | 40 | 17 | 0.4 | 1400 | ABSENCE | COMPARATIVE EXAMPLE |
| 21 | f | 45 | 55 | 0 | 100 | 0.8 | 70 | 30 | 100 | 17 | 0.4 | 2250 | ABSENCE | INVENTION EXAMPLE |
| 22 | g | 45 | 55 | 0 | 100 | 0.8 | 55 | 45 | 100 | 16 | 0.4 | 2690 | PRESENCE | INVENTION EXAMPLE |
| 23 | a | 0 | 0 | 0 | 0 | 0.6 | 60 | 40 | 100 | 24 | 0.7 | 1660 | ABSENCE | COMPARATIVE EXAMPLE |

TABLE 4-continued

| TEST No. | MARK OF STEEL | MICROSTRUCTURE AFTER FIRST QUENCHING: AREA FRACTION (%): TEMPERED MARTENSITE | FRESH MARTENSITE | BAINITE | TOTAL | DENSITY OF CARBIDE (/μm²) | MICROSTRUCTURE AFTER SECOND QUENCHING: AREA FRACTION (%): TEMPERED MARTENSITE | FRESH MARTENSITE | TOTAL | PRIOR γ GRAIN DIAMETER (μm) | AVERAGE GRAIN DIAMETER OF CARBIDE (μm) | MECHANICAL PROPERTY: TENSILE STRENGTH (MPa) | LOW-STRESS FRACTURE | REMARK |
|---|---|---|---|---|---|---|---|---|---|---|---|---|---|---|
| 24 | b | 50 | 50 | 0 | 100 | 0.7 | 60 | 40 | 100 | 20 | 0.5 | 1930 | ABSENCE | INVENTION EXAMPLE |
| 25 | c | 50 | 50 | 0 | 100 | 0.8 | 60 | 40 | 100 | 20 | 0.5 | 2020 | ABSENCE | INVENTION EXAMPLE |
| 26 | d | 50 | 50 | 0 | 100 | 0.7 | 60 | 40 | 100 | 18 | 0.5 | 2360 | ABSENCE | INVENTION EXAMPLE |
| 27 | e | 45 | 55 | 0 | 100 | 0.6 | 55 | 45 | 100 | 18 | 0.4 | 2660 | ABSENCE | INVENTION EXAMPLE |
| 28 | f | 0 | 0 | 45 | 45 | 0.6 | 55 | 45 | 100 | 22 | 0.7 | 1200 | PRESENCE | COMPARATIVE EXAMPLE |
| 29 | f | 0 | 0 | 0 | 0 | 0.5 | 55 | 45 | 100 | 24 | 0.8 | 1150 | PRESENCE | COMPARATIVE EXAMPLE |
| 30 | f | 45 | 55 | 0 | 100 | 0.8 | 50 | 50 | 100 | 19 | 0.3 | 1990 | PRESENCE | INVENTION EXAMPLE |
| 31 | f | 45 | 55 | 0 | 100 | 0.8 | 55 | 45 | 100 | 17 | 0.4 | 2410 | PRESENCE | INVENTION EXAMPLE |
| 32 | f | 45 | 55 | 0 | 100 | 0.7 | 65 | 35 | 100 | 24 | 0.4 | 1390 | PRESENCE | COMPARATIVE EXAMPLE |
| 33 | f | 70 | 0 | 30 | 100 | 0.5 | 55 | 45 | 100 | 19 | 0.8 | 1260 | PRESENCE | COMPARATIVE EXAMPLE |
| 34 | f | 45 | 55 | 0 | 100 | 0.6 | 60 | 40 | 100 | 26 | 0.5 | 1180 | PRESENCE | COMPARATIVE EXAMPLE |
| 35 | f | 50 | 50 | 0 | 100 | 0.8 | 45 | 0 | 45 | 17 | 0.4 | 1430 | ABSENCE | COMPARATIVE EXAMPLE |
| 36 | f | 50 | 50 | 0 | 100 | 0.8 | 70 | 30 | 100 | 17 | 0.4 | 2250 | ABSENCE | INVENTION EXAMPLE |

TABLE 5

| TEST No. | MARK OF STEEL | MICROSTRUCTURE AFTER FIRST QUENCHING: AREA FRACTION (%): TEMPERED MARTENSITE | FRESH MARTENSITE | BAINITE | TOTAL | DENSITY OF CARBIDE (/μm²) | MICROSTRUCTURE AFTER SECOND QUENCHING: AREA FRACTION (%): TEMPERED MARTENSITE | FRESH MARTENSITE | TOTAL | PRIOR γ GRAIN DIAMETER (μm) | AVERAGE GRAIN DIAMETER OF CARBIDE (μm) | MECHANICAL PROPERTY: TENSILE STRENGTH (MPa) | LOW-STRESS FRACTURE | REMARK |
|---|---|---|---|---|---|---|---|---|---|---|---|---|---|---|
| 37 | f | 45 | 55 | 0 | 100 | 0.8 | 55 | 45 | 100 | 18 | 0.4 | 2120 | ABSENCE | COMPARATIVE EXAMPLE |
| 38 | f | 40 | 60 | 0 | 100 | 0.6 | 55 | 45 | 100 | 18 | 0.3 | 2200 | ABSENCE | INVENTION EXAMPLE |
| 39 | f | 40 | 60 | 0 | 100 | 0.6 | 55 | 45 | 100 | 18 | 0.3 | 2240 | ABSENCE | INVENTION EXAMPLE |
| 40 | f | 45 | 55 | 0 | 100 | 0.8 | 60 | 40 | 100 | 14 | 0.4 | 2330 | ABSENCE | INVENTION EXAMPLE |

TABLE 5-continued

| TEST No. | MARK OF STEEL | MICROSTRUCTURE AFTER FIRST QUENCHING: AREA FRACTION (%): TEMPERED MARTENSITE | FRESH MARTENSITE | BAINITE | TOTAL | DENSITY OF CARBIDE (/μm²) | MICROSTRUCTURE AFTER SECOND QUENCHING: AREA FRACTION (%): TEMPERED MARTENSITE | FRESH MARTENSITE | TOTAL | PRIOR γ GRAIN DIAMETER (μm) | AVERAGE GRAIN DIAMETER OF CARBIDE (μm) | MECHANICAL PROPERTY: TENSILE STRENGTH (MPa) | LOW-STRESS FRACTURE | REMARK |
|---|---|---|---|---|---|---|---|---|---|---|---|---|---|---|
| 41 | f | 45 | 55 | 0 | 100 | 0.7 | 65 | 35 | 100 | 24 | 0.5 | 1370 | ABSENCE | INVENTION EXAMPLE |
| 42 | f | 0 | 0 | 0 | 0 | 0.6 | 65 | 35 | 100 | 23 | 0.7 | 1280 | PRESENCE | COMPARATIVE EXAMPLE |
| 43 | f | 65 | 0 | 35 | 100 | 0.5 | 55 | 45 | 100 | 18 | 0.8 | 1250 | PRESENCE | COMPARATIVE EXAMPLE |
| 44 | f | 50 | 50 | 0 | 100 | 0.6 | 60 | 40 | 100 | 26 | 0.6 | 1160 | PRESENCE | INVENTION EXAMPLE |
| 45 | f | 55 | 45 | 0 | 100 | 0.7 | 40 | 0 | 40 | 17 | 0.5 | 1420 | PRESENCE | INVENTION EXAMPLE |
| 46 | f | 55 | 45 | 0 | 100 | 0.7 | 70 | 30 | 100 | 17 | 0.5 | 2230 | PRESENCE | INVENTION EXAMPLE |
| 47 | f | 45 | 55 | 0 | 100 | 0.8 | 55 | 45 | 100 | 17 | 0.4 | 2110 | PRESENCE | INVENTION EXAMPLE |
| 48 | f | 45 | 55 | 0 | 100 | 0.8 | 55 | 45 | 100 | 18 | 0.3 | 2230 | PRESENCE | INVENTION EXAMPLE |
| 49 | f | 40 | 60 | 0 | 100 | 0.6 | 55 | 45 | 100 | 17 | 0.3 | 2230 | PRESENCE | INVENTION EXAMPLE |
| 50 | f | 45 | 55 | 0 | 100 | 0.8 | 60 | 40 | 100 | 14 | 0.4 | 2340 | PRESENCE | INVENTION EXAMPLE |
| 51 | f | 50 | 50 | 0 | 100 | 0.8 | 60 | 40 | 100 | 22 | 0.4 | 1430 | PRESENCE | INVENTION EXAMPLE |
| 52 | f | 0 | 0 | 0 | 0 | 0.6 | 70 | 30 | 100 | 24 | 0.7 | 1260 | ABSENCE | INVENTION EXAMPLE |
| 53 | f | 70 | 0 | 30 | 100 | 0.6 | 60 | 40 | 100 | 19 | 0.8 | 1250 | PRESENCE | COMPARATIVE EXAMPLE |
| 54 | f | 45 | 55 | 0 | 100 | 0.6 | 40 | 60 | 100 | 26 | 0.5 | 1180 | PRESENCE | COMPARATIVE EXAMPLE |
| 55 | f | 50 | 50 | 0 | 100 | 0.7 | 40 | 0 | 40 | 18 | 0.4 | 1440 | PRESENCE | COMPARATIVE EXAMPLE |
| 56 | f | 50 | 50 | 0 | 100 | 0.7 | 65 | 35 | 100 | 17 | 0.5 | 2230 | ABSENCE | COMPARATIVE EXAMPLE |
| 57 | e | 50 | 50 | 0 | 100 | 0.6 | 55 | 45 | 100 | 18 | 0.5 | 2600 | ABSENCE | INVENTION EXAMPLE |
| 58 | f | 45 | 55 | 0 | 100 | 0.8 | 55 | 45 | 100 | 17 | 0.4 | 2130 | PRESENCE | INVENTION EXAMPLE |
| 59 | f | 45 | 55 | 0 | 100 | 0.8 | 55 | 45 | 100 | 17 | 0.3 | 2230 | ABSENCE | COMPARATIVE EXAMPLE |
| 60 | f | 40 | 60 | 0 | 100 | 0.9 | 55 | 45 | 100 | 17 | 0.3 | 2260 | ABSENCE | INVENTION EXAMPLE |
| 61 | f | 45 | 55 | 0 | 100 | 0.7 | 50 | 50 | 100 | 14 | 0.5 | 2330 | ABSENCE | INVENTION EXAMPLE |
| 62 | f | 45 | 55 | 0 | 100 | 0.7 | 55 | 45 | 100 | 13 | 0.4 | 2300 | ABSENCE | INVENTION EXAMPLE |
| 63 | f | 45 | 55 | 0 | 100 | 0.7 | 45 | 55 | 100 | 5 | 0.5 | 2710 | ABSENCE | INVENTION EXAMPLE |
| 64 | f | 45 | 55 | 0 | 100 | 0.7 | 65 | 35 | 100 | 24 | 0.4 | 1420 | PRESENCE | COMPARATIVE EXAMPLE |
| 65 | f | 0 | 0 | 0 | 0 | 0.7 | 60 | 40 | 100 | 22 | 0.6 | 1300 | PRESENCE | COMPARATIVE EXAMPLE |
| 66 | f | 65 | 0 | 35 | 100 | 0.5 | 55 | 45 | 100 | 19 | 0.8 | 1270 | PRESENCE | INVENTION EXAMPLE |
| 67 | f | 45 | 55 | 0 | 100 | 0.6 | 40 | 60 | 100 | 26 | 0.5 | 1180 | PRESENCE | INVENTION EXAMPLE |

TABLE 5-continued

| TEST No. | MARK OF STEEL | MICROSTRUCTURE AFTER FIRST QUENCHING: AREA FRACTION (%): TEMPERED MARTENSITE | FRESH MARTENSITE | BAINITE | TOTAL | DENSITY OF CARBIDE (/μm²) | MICROSTRUCTURE AFTER SECOND QUENCHING: AREA FRACTION (%): TEMPERED MARTENSITE | FRESH MARTENSITE | TOTAL | PRIOR γ GRAIN DIAMETER (μm) | AVERAGE GRAIN DIAMETER OF CARBIDE (μm) | MECHANICAL PROPERTY: TENSILE STRENGTH (MPa) | LOW-STRESS FRACTURE | REMARK |
|---|---|---|---|---|---|---|---|---|---|---|---|---|---|---|
| 68 | f | 55 | 45 | 0 | 100 | 0.8 | 45 | 0 | 45 | 16 | 0.5 | 1420 | PRESENCE | COMPARATIVE EXAMPLE |
| 69 | f | 50 | 50 | 0 | 100 | 0.8 | 65 | 35 | 100 | 17 | 0.5 | 2240 | PRESENCE | COMPARATIVE EXAMPLE |
| 70 | g | 45 | 55 | 0 | 100 | 0.7 | 50 | 50 | 100 | 16 | 0.4 | 2670 | ABSENCE | INVENTION EXAMPLE |

As illustrated in Table 4 and Table 5, in invention examples in ranges of the present invention (tests No. 2 to No. 5, No. 8 to No. 16, No. 21 to No. 22, No. 24 to No. 27, No. 30 to No. 31, No. 36 to No. 40, No. 46 to No. 50, No. 56 to No. 63, No. 69 to No. 70), the low-stress fracture did not occur, or even though it occurred, the stress in which a fracture occurred was 1800 MPa or more.

In a test No. 1, a holding temperature of the first quenching was too low, so that a prior γ grain diameter of the hot stamped part fell short, an average grain diameter of carbides was excessive, and sufficient tensile strength was not able to be obtained. In a test No. δ, the first quenching was not performed, so that a prior γ grain diameter of the hot stamped part fell short, an average grain diameter of carbides was excessive, a low-stress fracture occurred, and sufficient tensile strength was not able to be obtained. In a test No. 7, a cooling stop temperature of the first quenching was too high, so that a prior γ grain diameter of the hot stamped part fell short, an average grain diameter of carbides was excessive, a low-stress fracture occurred, and sufficient tensile strength was not able to be obtained.

In a test No. 17, an average heating rate of the first quenching was too low, so that a prior γ grain diameter of the hot stamped part fell short, a low-stress fracture occurred, and sufficient tensile strength was not able to be obtained. In a test No. 18, a holding temperature of the first quenching was too low, so that a prior γ grain diameter of the hot stamped part fell short, an average grain diameter of carbides was excessive, a low-stress fracture occurred, and sufficient tensile strength was not able to be obtained. In a test No. 19, an average heating rate of the second quenching was too low, so that a prior γ grain diameter of the hot stamped part fell short, a low-stress fracture occurred, and sufficient tensile strength was not able to be obtained. In a test No. 20, a cooling stop temperature of the second quenching was too high, so that a total area fraction of fresh martensite and tempered martensite fell short, and sufficient tensile strength was not able to be obtained.

In a test No. 23, a holding temperature of the first quenching was too low, so that a prior γ grain diameter of the hot stamped part fell short, an average grain diameter of carbides was excessive, and sufficient tensile strength was not able to be obtained. In a test No. 28, a holding temperature of the first quenching was too low, so that a prior γ grain diameter of the hot stamped part fell short, an average grain diameter of carbides was excessive, a low-stress fracture occurred, and sufficient tensile strength was not able to be obtained. In a test No. 29, the first quenching was not performed, so that a prior γ grain diameter of the hot stamped part fell short, an average grain diameter of carbides was excessive, a low-stress fracture occurred, and sufficient tensile strength was not able to be obtained. In a test No. 32, an average heating rate of the first quenching was too low, so that a prior γ grain diameter of the hot stamped part fell short, a low-stress fracture occurred, and sufficient tensile strength was not able to be obtained. In a test No. 33, a cooling stop temperature of the first quenching was too high, so that an average grain diameter of carbides of the hot stamped part was excessive, a low-stress fracture occurred, and sufficient tensile strength was not able to be obtained. In a test No. 34, an average heating rate of the second quenching was too low, so that a prior γ grain diameter of the hot stamped part fell short, a low-stress fracture occurred, and sufficient tensile strength was not able to be obtained. In a test No. 35, a cooling stop temperature of the second quenching was too high, so that a total area fraction of fresh martensite and tempered martensite fell short, and sufficient tensile strength was not able to be obtained.

In a test No. 41, an average heating rate of the first quenching was too low, so that a prior γ grain diameter of the hot stamped part fell short, a low-stress fracture occurred, and sufficient tensile strength was not able to be obtained. In a test No. 42, a holding temperature of the first quenching was too low, so that a prior γ grain diameter of the hot stamped part fell short, an average grain diameter of carbides was excessive, a low-stress fracture occurred, and sufficient tensile strength was not able to be obtained. In a test No. 43, a cooling stop temperature of the first quenching was too high, so that an average grain diameter of carbides of the hot stamped part was excessive, a low-stress fracture occurred, and sufficient tensile strength was not able to be obtained. In a test No. 44, an average heating rate of the second quenching was too low, so that a prior γ grain diameter of the hot stamped part fell short, a low-stress fracture occurred, and sufficient tensile strength was not able to be obtained. In a test No. 45, a cooling stop temperature of the second quenching was too high, so that a total area fraction of fresh martensite and tempered martensite fell short, and sufficient tensile strength was not able to be obtained.

In a test No. 51, an average heating rate of the first quenching was too low, so that a prior γ grain diameter of the hot stamped part fell short, a low-stress fracture occurred, and sufficient tensile strength was not able to be obtained. In a test No. 52, a holding temperature of the first quenching was too low, so that a prior γ grain diameter of the hot stamped part fell short, an average grain diameter of carbides was excessive, a low-stress fracture occurred, and sufficient tensile strength was not able to be obtained. In a test No. 53, a cooling stop temperature of the first quenching was too high, so that an average grain diameter of carbides of the hot stamped part was excessive, a low-stress fracture occurred, and sufficient tensile strength was not able to be obtained. In a test No. 54, an average heating rate of the second quenching was too low, so that a prior γ grain diameter of the hot stamped part fell short, a low-stress fracture occurred, and sufficient tensile strength was not able to be obtained. In a test No. 55, a cooling stop temperature of the second quenching was too high, so that a total area fraction of fresh martensite and tempered martensite fell short, and sufficient tensile strength was not able to be obtained.

In a test No. 64, an average heating rate of the first quenching was too low, so that a prior γ grain diameter of the hot stamped part fell short, a low-stress fracture occurred, and sufficient tensile strength was not able to be obtained. In a test No. 65, a holding temperature of the first quenching was too low, so that a prior γ grain diameter of the hot stamped part fell short, an average grain diameter of carbides was excessive, a low-stress fracture occurred, and sufficient tensile strength was not able to be obtained. In a test No. 66, a cooling stop temperature of the first quenching was too high, so that an average grain diameter of carbides of the hot stamped part was excessive, a low-stress fracture occurred, and sufficient tensile strength was not able to be obtained. In a test No. 67, an average heating rate of the second quenching was too low, so that a prior γ grain diameter of the hot stamped part fell short, a low-stress fracture occurred, and sufficient tensile strength was not able to be obtained. In a test No. 68, a cooling stop temperature of the second quenching was too high, so that a total area fraction of fresh martensite and tempered martensite fell short, and sufficient tensile strength was not able to be obtained.

(Second Experiment)

In a second experiment, blank materials were formed in manners similar to those in the tests No. 10, No. 31, No. 37, No. 47 and No. 58 in the first experiment, and the first quenching (first heat treatment), the second quenching (second heat treatment) and a third quenching (third heat treatment) of the blank materials were performed. Table 6 presents the condition of the first heat treatment, the condition of the second heat treatment and conditions of the third heat treatment. As presented in Table 6, in the third heat treatment, atmosphere heating was performed when a heating rate was 50° C./sec or less, and electric heating was performed when it was more than 50° C./sec. Air cooling from a holding temperature to 700° C., and cooling at an average cooling rate of 100° C./sec while performing press forming in a die from 700° C. to a cooling stop temperature were performed. Thus, various hot stamped parts were manufactured.

TABLE 6

| TEST No. | MARK OF STEEL | STEEL TYPE | FIRST QUENCHING (FIRST HEAT TREATMENT), SECOND QUENCHING (SECOND HEAT TREATMENT) | AVERAGE HEATING RATE (° C./sec) | HOLDING TEMPERATURE (° C.) | HOLDING TIME (sec) | COOLING STOP TEMPERATURE (° C.) | REMARK |
|---|---|---|---|---|---|---|---|---|
| 71 | f | COLD-ROLLED STEEL SHEET | SAME AS TEST No. 10 | 10 | 930 | 10 | 200 | INVENTION EXAMPLE |
| 72 | f | COLD-ROLLED STEEL SHEET | SAME AS TEST No. 10 | 3 | 930 | 10 | 200 | INVENTION EXAMPLE |
| 73 | f | COLD-ROLLED STEEL SHEET | SAME AS TEST No. 10 | 300 | 930 | 10 | 200 | INVENTION EXAMPLE |
| 74 | f | COLD-ROLLED STEEL SHEET | SAME AS TEST No. 10 | 10 | 850 | 10 | 200 | INVENTION EXAMPLE |
| 75 | f | COLD-ROLLED STEEL SHEET | SAME AS TEST No. 10 | 300 | 930 | 0.1 | 200 | INVENTION EXAMPLE |
| 76 | f | COLD-ROLLED STEEL SHEET | SAME AS TEST No. 10 | 10 | 930 | 500 | 200 | INVENTION EXAMPLE |
| 77 | f | COLD-ROLLED STEEL SHEET | SAME AS TEST No. 10 | 10 | 930 | 10 | 250 | INVENTION EXAMPLE |
| 78 | f | HOT-ROLLED STEEL SHEET | SAME AS TEST No. 31 | 10 | 930 | 10 | 100 | INVENTION EXAMPLE |
| 79 | f | HOT-ROLLED STEEL SHEET | SAME AS TEST No. 31 | 10 | 1150 | 10 | 100 | INVENTION EXAMPLE |
| 80 | f | ALUMINUM-PLATED STEEL SHEET | SAME AS TEST No. 37 | 10 | 930 | 10 | 100 | INVENTION EXAMPLE |
| 81 | f | ALUMINUM-PLATED STEEL SHEET | SAME AS TEST No. 37 | 300 | 930 | 10 | 100 | INVENTION EXAMPLE |
| 82 | f | HOT-DIP GALVANIZED STEEL SHEET | SAME AS TEST No. 47 | 10 | 930 | 10 | 100 | INVENTION EXAMPLE |
| 83 | f | HOT-DIP GALVANIZED STEEL SHEET | SAME AS TEST No. 47 | 300 | 930 | 10 | 100 | INVENTION EXAMPLE |

TABLE 6-continued

| TEST No. | MARK OF STEEL | STEEL TYPE | FIRST QUENCHING (FIRST HEAT TREATMENT), SECOND QUENCHING (SECOND HEAT TREATMENT) | AVERAGE HEATING RATE (° C./sec) | HOLDING TEMPERATURE (° C.) | HOLDING TIME (sec) | COOLING STOP TEMPERATURE (° C.) | REMARK |
|---|---|---|---|---|---|---|---|---|
| 84 | f | ALLOYED HOT-DIP GALVANIZED STEEL SHEET | SAME AS TEST No. 58 | 10 | 930 | 10 | 50 | INVENTION EXAMPLE |
| 85 | f | ALLOYED HOT-DIP GALVANIZED STEEL SHEET | SAME AS TEST No. 58 | 1000 | 930 | 0.1 | 50 | INVENTION EXAMPLE |
| 86 | f | ALLOYED HOT-DIP GALVANIZED STEEL SHEET | SAME AS TEST No. 58 | 200 | 930 | 10 | 50 | INVENTION EXAMPLE |

Then, microstructures after the third heat treatment were observed. Table 7 presents this result. An observation method of the microstructures is as described above. Further, a tensile test was performed in a manner similar to that in the first experiment. Table 7 also presents this result.

TABLE 7

| | | MICROSTRUCTURE AFTER AFTER THIRD QUENCHING | | | | | | | |
|---|---|---|---|---|---|---|---|---|---|
| | | AREA FRACTION (%) | | | PRIOR γ GRAIN DIAMETER (μm) | AVERAGE GRAIN DIAMETER OF CARBIDE (μm) | MECHANICAL PROPERTY | | |
| TEST No. | MARK OF STEEL | TEMPERED MARTENSITE | FRESH MARTENSITE | TOTAL | | | TENSILE STRENGTH (MPa) | LOW-STRESS FRACTURE | REMARK |
| 71 | f | 55 | 45 | 100 | 15 | 0.4 | 2250 | PRESENCE | INVENTION EXAMPLE |
| 72 | f | 60 | 40 | 100 | 15 | 0.5 | 2210 | PRESENCE | INVENTION EXAMPLE |
| 73 | f | 50 | 50 | 100 | 13 | 0.5 | 2270 | PRESENCE | INVENTION EXAMPLE |
| 74 | f | 50 | 50 | 100 | 11 | 0.4 | 2300 | PRESENCE | INVENTION EXAMPLE |
| 75 | f | 50 | 50 | 100 | 10 | 0.4 | 2720 | ABSENCE | INVENTION EXAMPLE |
| 76 | f | 60 | 40 | 100 | 16 | 0.5 | 2140 | PRESENCE | INVENTION EXAMPLE |
| 77 | f | 60 | 40 | 100 | 15 | 0.5 | 2220 | PRESENCE | INVENTION EXAMPLE |
| 78 | f | 55 | 45 | 100 | 14 | 0.5 | 2240 | PRESENCE | INVENTION EXAMPLE |
| 79 | f | 60 | 40 | 100 | 16 | 0.4 | 2140 | PRESENCE | INVENTION EXAMPLE |
| 80 | f | 55 | 45 | 100 | 14 | 0.5 | 2240 | PRESENCE | INVENTION EXAMPLE |
| 81 | f | 50 | 50 | 100 | 13 | 0.5 | 2260 | PRESENCE | INVENTION EXAMPLE |
| 82 | f | 55 | 45 | 100 | 14 | 0.5 | 2230 | PRESENCE | INVENTION EXAMPLE |
| 83 | f | 50 | 50 | 100 | 13 | 0.5 | 2250 | PRESENCE | INVENTION EXAMPLE |
| 84 | f | 55 | 45 | 100 | 14 | 0.5 | 2230 | PRESENCE | INVENTION EXAMPLE |
| 85 | f | 50 | 50 | 100 | 10 | 0.4 | 2730 | ABSENCE | INVENTION EXAMPLE |
| 86 | f | 50 | 50 | 100 | 12 | 0.5 | 2270 | PRESENCE | INVENTION EXAMPLE |

As presented in Table 7, in any invention example, a smaller prior γ grain diameter and a more excellent mechanical property were obtained than those in the invention examples (tests No. 10, No. 31, No. 37, No. 47 or No. 58) in each of which the third quenching was not performed.

INDUSTRIAL APPLICABILITY

The present invention can be utilized in, for example, industries related to a hot stamped part suitable for automotive parts.

The invention claimed is:

1. A hot stamped part obtained by a manufacturing method of the hot stamped part comprising a microstructure represented by an area fraction of fresh martensite and tempered martensite: 80% or more in total, a prior austenite grain diameter: 20 μm or less, and an average grain diameter of carbides: not less than 0.3 μm nor more than 0.5 μm, the manufacturing method of the hot stamped part comprising a step of forming a blank material from a steel sheet;

wherein the steel sheet has a chemical composition represented by, in mass %,

C: 0.27% to 0.60%,

Mn: 0.50% to 5.00%,

Si: 2.00% or less,

P: 0.030% or less,

S: 0.0100% or less, acid-soluble Al (sol. Al): 0.100% or less,

N: 0.0100% or less,

B: 0.0000% to 0.0050%,

Cr: 0.00% to 0.50%,

Mo: 0.00% to 0.50%,
Ti: 0.000% to 0.100%,
Nb: 0.000% to 0.100%,
V: 0.000% to 0.100%,
Cu: 0.000% to 1.000%,
Ni: 0.000% to 1.000%,
O: 0.00% to 0.02%,
W: 0.0% to 0.1%,
Ta: 0.0% to 0.1%,
Sn: 0.00% to 0.05%,
Sb: 0.00% to 0.05%,
As: 0.00% to 0.05%,
Mg: 0.00% to 0.05%,
Ca: 0.00% to 0.05%,
Y: 0.00% to 0.05%,
Zr: 0.00% to 0.05%,
La: 0.00% to 0.05%, or
Ce: 0.00% to 0.05%, and
the balance: Fe and impurities;

a step of performing a first quenching of the blank material; and a step of performing a second quenching of the blank material after the first quenching, wherein the step of performing the first quenching comprises:

a step of heating the blank material to a first temperature of not lower than (Ac3 point—50)° C. nor higher than 1200° C. at an average heating rate of 2° C./sec or more; and a step of cooling the blank material from the first temperature to a second temperature of 250° C. or lower, wherein the step of performing the second quenching comprises:

a step of heating the blank material from the second temperature to a third temperature of not lower than (Ac3 point—50)° C. nor higher than 1200° C. at an average heating rate of 2° C./sec or more; and a step of cooling the blank material from the third temperature to a fourth temperature of 250° C. or lower, and wherein forming of the blank material is performed in the first quenching or the second quenching or both of the first quenching and the second quenching.

2. The hot stamped part obtained by the manufacturing method of the hot stamped part according to claim 1, wherein a Vickers hardness is 550 Hv or more.

3. The hot stamped part obtained by the manufacturing method of the hot stamped part according to claim 1, comprising a step of holding at the first temperature for one second or longer between the step of heating to the first temperature and the step of cooling to the second temperature.

4. The hot stamped part obtained by the manufacturing method of the hot stamped part according to claim 1, wherein the third temperature is not lower than (Ac3 point—50)° C. nor higher than 1000° C.

5. The hot stamped part obtained by the manufacturing method of the hot stamped part according to claim 1, wherein heating from the second temperature to the third temperature is performed at an average heating rate of 5° C./sec or more.

6. The hot stamped part obtained by the manufacturing method of the hot stamped part according to claim 1, comprising a step of holding at the third temperature for not shorter than 0.1 seconds nor longer than 300 seconds between the step of heating to the third temperature and the step of cooling to the fourth temperature.

7. The hot stamped part obtained by the manufacturing method of the hot stamped part according to claim 1, wherein the step of performing the second quenching comprises a step of cooling the blank material to a fifth temperature from 0.700° C. to Ms point—50° C. at an average cooling rate of 20° C./sec.

* * * * *